US006957682B2

(12) United States Patent
Huang et al.

(10) Patent No.: US 6,957,682 B2
(45) Date of Patent: Oct. 25, 2005

(54) CARRIER-POSITIONING DEVICE FOR A VERTICAL BLIND

(76) Inventors: Tai-Long Huang, No. 382, Yuan-Lu Rd., Sec. 1, Fuhsing, Changhua (TW); Chou-Ho Sung, No. 118, Pei-Jen St., Pei-Shih Tsun, Kuan-Miao, Tainan (TW)

( * ) Notice: Subject to any disclaimer, the term of this patent is extended or adjusted under 35 U.S.C. 154(b) by 28 days.

(21) Appl. No.: 10/733,787

(22) Filed: Dec. 11, 2003

(65) Prior Publication Data

US 2005/0126718 A1 Jun. 16, 2005

(51) Int. Cl.[7] ..... E06B 9/36
(52) U.S. Cl. ..... 160/168.1 V; 160/178.1 V; 160/900
(58) Field of Search ..... 160/178.1 V, 173 V, 160/168.1 V, 900, 902; 248/222.12, 225.21; 24/614, 615

(56) References Cited

U.S. PATENT DOCUMENTS 4,291,738 A * 9/1981 Grenga et al. ..... 160/176.1 R
5,445,205 A * 8/1995 Hansen ..... 160/168.1 R
5,992,495 A * 11/1999 Cadorette ..... 160/168.1 V
6,408,623 B1 * 6/2002 Mollier et al. ..... 60/588

* cited by examiner

*Primary Examiner*—Blair M. Johnson
(74) *Attorney, Agent, or Firm*—Grossman Tucker Perreault & Pfleger, PLLC

(57) ABSTRACT

A carrier-positioning device for a vertical blind includes an end cover attached fixedly to an end of a headrail, and a positioning member connected fixedly to the end cover. The positioning member has a hook end including two hooks, each of which is formed with a vertical retaining slot that has a closed upper end and an open lower end and that engages a respective one of two wheel pins on two opposite sides of a carrier so as to prevent movement of the carrier within the headrail. An operable portion of the positioning member is connected fixedly to the hook end, and has an exposed section that is exposed within a space between two supporting walls of the headrail so that it can be pushed upwardly to remove the hooks from the wheel pins, thereby permitting separation of the carrier from the end cover.

5 Claims, 8 Drawing Sheets

CARRIER-POSITIONING DEVICE FOR A VERTICAL BLIND

BACKGROUND OF THE INVENTION

1. Field of the Invention

This invention relates to a vertical blind that includes a plurality of vertical slats suspended respectively from a plurality of carriers, and more particularly to a carrier-positioning device for a vertical blind.

2. Description of the Related Art

Referring to FIGS. 1 and 2, a conventional vertical blind 1 is shown to include a headrail 11, a rotating shaft 12 journalled within the headrail 11, a plurality of carriers 13 (only one is shown in FIG. 1) sleeved movably around the rotating shaft 12, an end cover 14 attached fixedly to an end of the headrail 11, a positioning member 15 connected to the rightmost carrier 13 and the end cover 14 so as to position the rightmost carrier 13 relative to the end cover 14, and a plurality of vertical slats 16 (only one is shown in FIG. 1) suspended respectively from the carriers 13.

When it is desired to mount the vertical blind 1 on a window (not shown), there is a need to cut and shorten the headrail 11 and the rotating shaft 12 so as to conform to the size of the window (not shown). It is also necessary to separate the rightmost carrier 13 from the positioning member 15 prior to cutting of the headrail 11 and the rotating shaft 12. Referring to FIG. 2, normally, an index finger 17 of the operator is inserted into the headrail 11 to push the positioning member 15 away from the rotating shaft 12 so as to remove a hook end 18 of the positioning member 15 from a vertical plate 19 of the rightmost carrier 13. However, the index finger 17 of the operator may be hurt by two supporting walls 111 of the headrail 11 in view of the fact that it must pass through a relatively small space between the rotating shaft 12 and one of the supporting walls 111. Furthermore, because the positioning member 15 engages only one side of the rightmost carrier 13, the rightmost carrier 13 tends to tilt within the headrail 11.

SUMMARY OF THE INVENTION

An object of this invention is to provide a carrier-positioning device for a vertical blind that includes a positioning member which can be operated easily to be separated from a carrier without hurting the operator.

Another object of this invention is to provide a carrier-positioning device for a vertical blind that includes a positioning member which engages two opposite sides of a carrier so that tilting of the carrier can be prevented.

According to this invention, a carrier-positioning device for a vertical blind includes an end cover attached fixedly to an end of a headrail, and a positioning member connected fixedly to the end cover. The positioning member has a hook end including two hooks, each of which is formed with a vertical retaining slot that has a closed upper end and an open lower end and that engages a respective one of two wheel pins on two opposite sides of a carrier so as to prevent movement of the carrier within the headrail. An operable portion of the positioning member is connected fixedly to the hook end, and has an exposed section that is exposed within a space between two supporting walls of the headrail so that it can be pushed upwardly to remove the hooks from the wheel pins, thereby permitting separation of the carrier from the end cover.

As such, when the operator pushes the operable portion of the positioning member upwardly with one finger, the finger will not be hurt by the supporting walls of the headrail.

Furthermore, because the positioning member engages the wheel pins at two opposite sides of the carrier, tilting of the carrier can be prevented.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
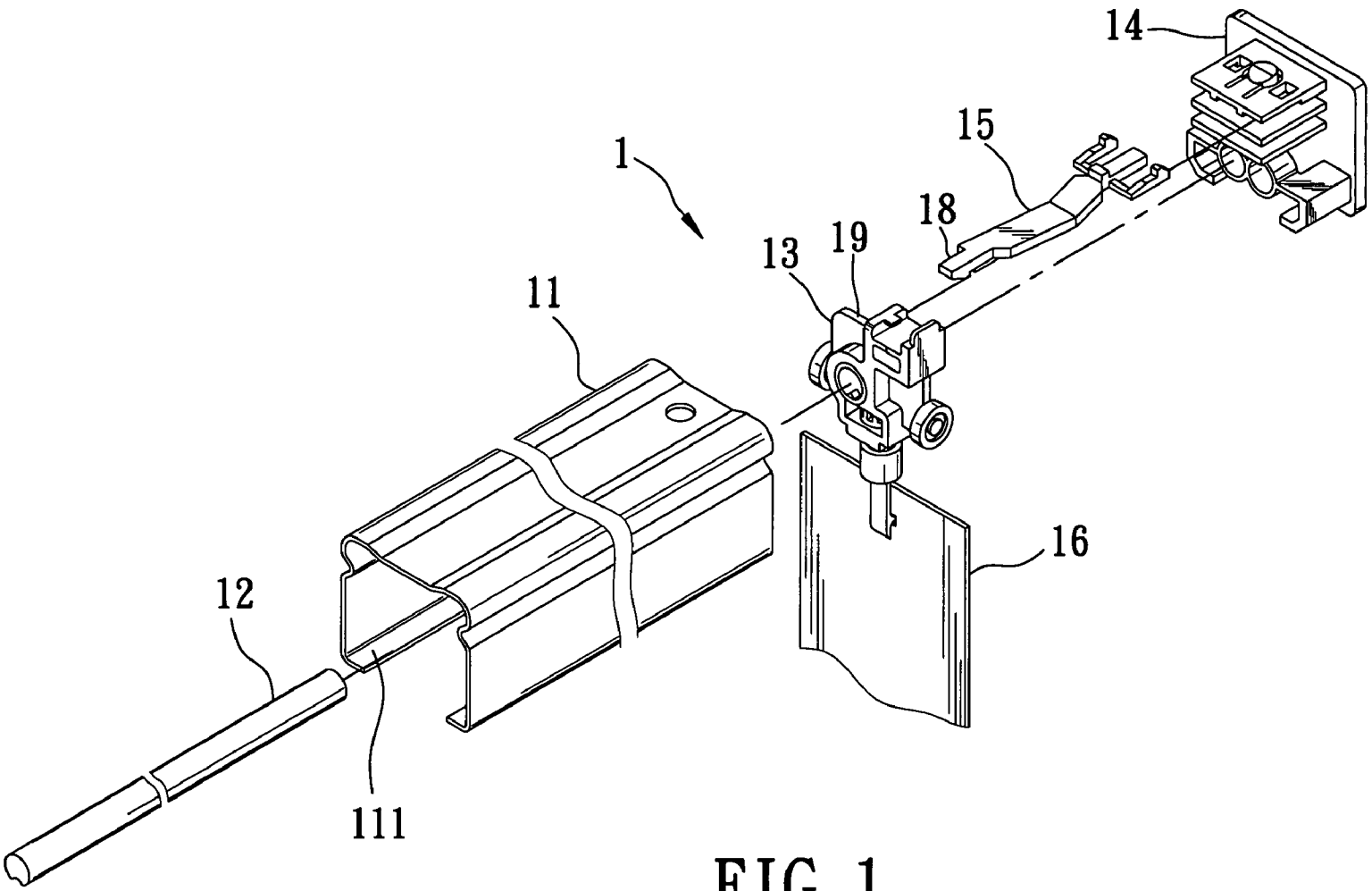
FIG. 1 PRIOR ART
FIG. 1 is a fragmentary partly exploded perspective view of a conventional vertical blind.
Figure 2:
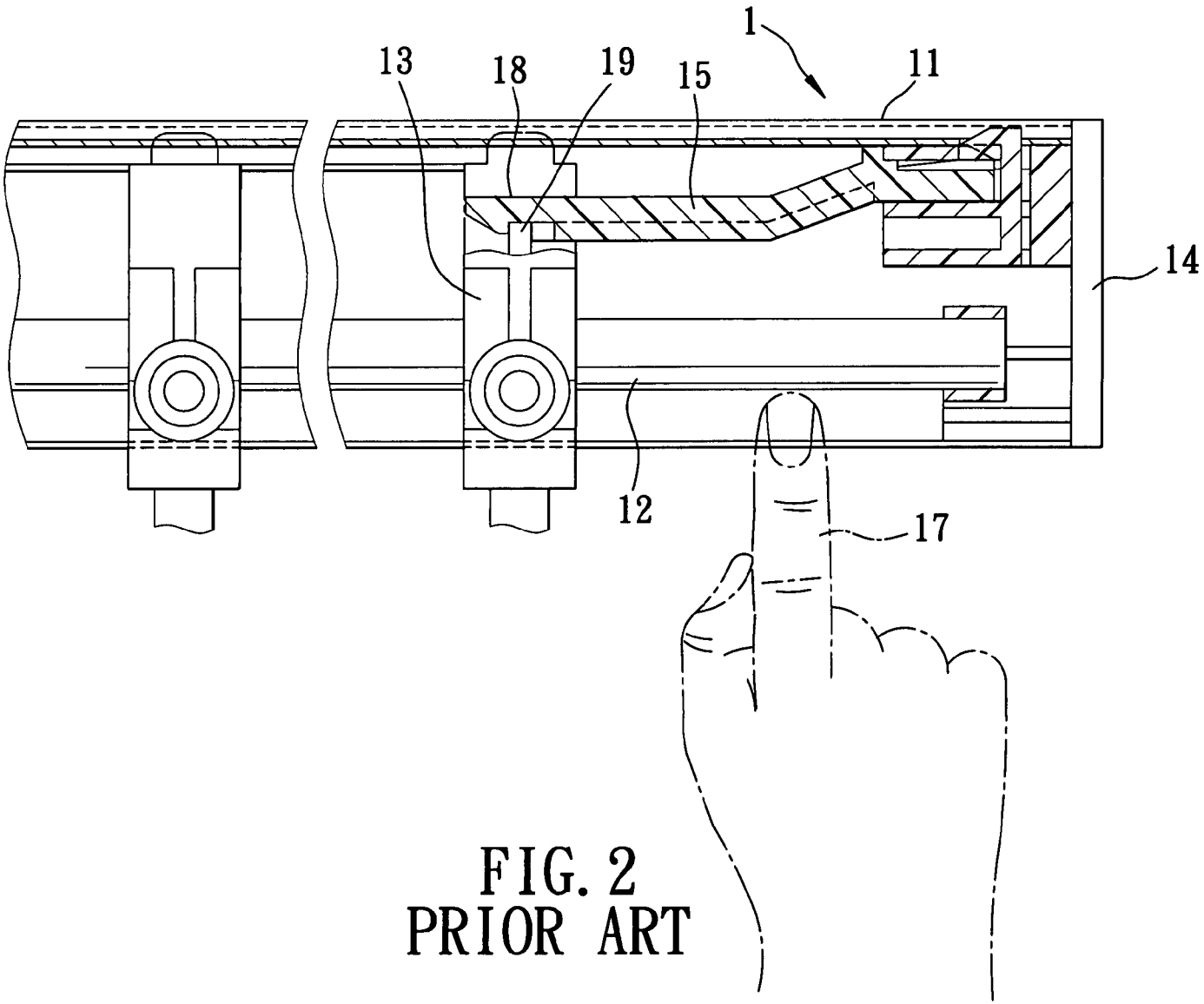
FIG. 2 PRIOR ART
FIG. 2 is a fragmentary sectional view of the conventional vertical blind, illustrating how a positioning member is removed from a carrier.

Referring to FIGS. 3, 4, 5, and 6, the preferred embodiment of a carrier-positioning device for a vertical blind according to this invention is shown to include an end cover 5 and a flexible positioning member 6. The vertical blind includes a headrail 2, a rotating shaft 3 journalled within the headrail 2, a plurality of carriers 4 sleeved movably around the rotating shaft 3, and a plurality of vertical slats 7 suspended respectively from the carriers 4. The headrail 2 includes a top wall 21, two sidewalls 22 extending respectively and downwardly from two opposite sides of the top wall 21, and two supporting walls 23 extending respectively from lower ends of the sidewalls 22 toward each other. Each of the carriers 4 is formed with two horizontal wheel pins 41 that extend respectively and outwardly from two opposite sides thereof, and two wheels 42 sleeved respectively and rotatably around the wheel pins 41 and movable respectively on the supporting walls 23 so as to facilitate movement of the carriers 4 within the headrail 2.

The end cover 5 is made of plastic material, is attached fixedly to an end of the headrail 2, and includes a vertical end wall 51 having an inner side surface 511 proximate to the headrail 2, and an engagement portion 52 formed on the inner side surface 511 of the end wall 51. The engagement portion 52 is generally inverted T-shaped, and includes a top plate 521, a bottom plate 522, and two connecting plates 523 having upper ends that are connected respectively and fixedly to two opposite sides of the top plate 521, and lower ends that are connected respectively and fixedly to two opposite sides of the bottom plate 522. The top plate 521 has a middle horizontal plate portion (521A) (see FIG. 5), two vertical plate portions (521B) (see FIG. 5) extending respectively, integrally, and downwardly from two opposite sides of the middle horizontal plate portion (521A), and two side horizontal plate portions (521C) (see FIG. 5) extending respectively, integrally, and outwardly from lower ends of the vertical plate portions (521B). The bottom plate 522 has a transverse retaining slot 524 that is formed through an intermediate portion thereof, that extends in a transverse direction (Y) (see FIG. 3) of the headrail 2, and that has two closed ends.

The positioning member 6 is also made of plastic material, has a fixed end 61, a hook end 62, and an operable portion 63 disposed between and connected fixedly to the fixed end 61 and the hook end 62.

The fixed end 61 of the positioning member 6 includes a base wall 611, two vertical outer walls 612, two retaining walls 613, and two ribs 614. The base wall 611 abuts against a bottom surface of the bottom plate 522 of the engagement portion 52 of the end cover 5. The outer walls 612 extend integrally, respectively, and upwardly from two opposite sides of the base wall 611, flank the engagement portion 52 of the end cover 5, and have inner side surfaces that face each other and that abut respectively against the connecting plates 523 so as to prevent movement of the positioning member 6 relative to the end cover 5 in the transverse direction (Y) of the headrail 2. The retaining walls 613 extend respectively from upper ends of the outer walls 612 toward each other, and abut respectively against the top plate 521 so as to prevent vertical movement of the positioning member 6 relative to the end cover 5. The ribs 614 project integrally and upwardly from the base wall 611 and through the transverse retaining slot 524 in the bottom plate 522 of the engagement portion 52 of the end cover 5, are disposed between the outer walls 612, and extend in a longitudinal direction (X) (see FIG. 3) of the headrail 2. Each of the ribs 614 has a length proximate to the width of the transverse retaining slot 524 in the bottom plate 522 of the engagement portion 52 of the end cover 5 so as to prevent movement of the positioning member 6 relative to the end cover 5 in the longitudinal direction (X) of the headrail 2. Alternatively, the positioning member 6 can be formed integrally with the end wall 51 of the end cover 5.

Figure 7:
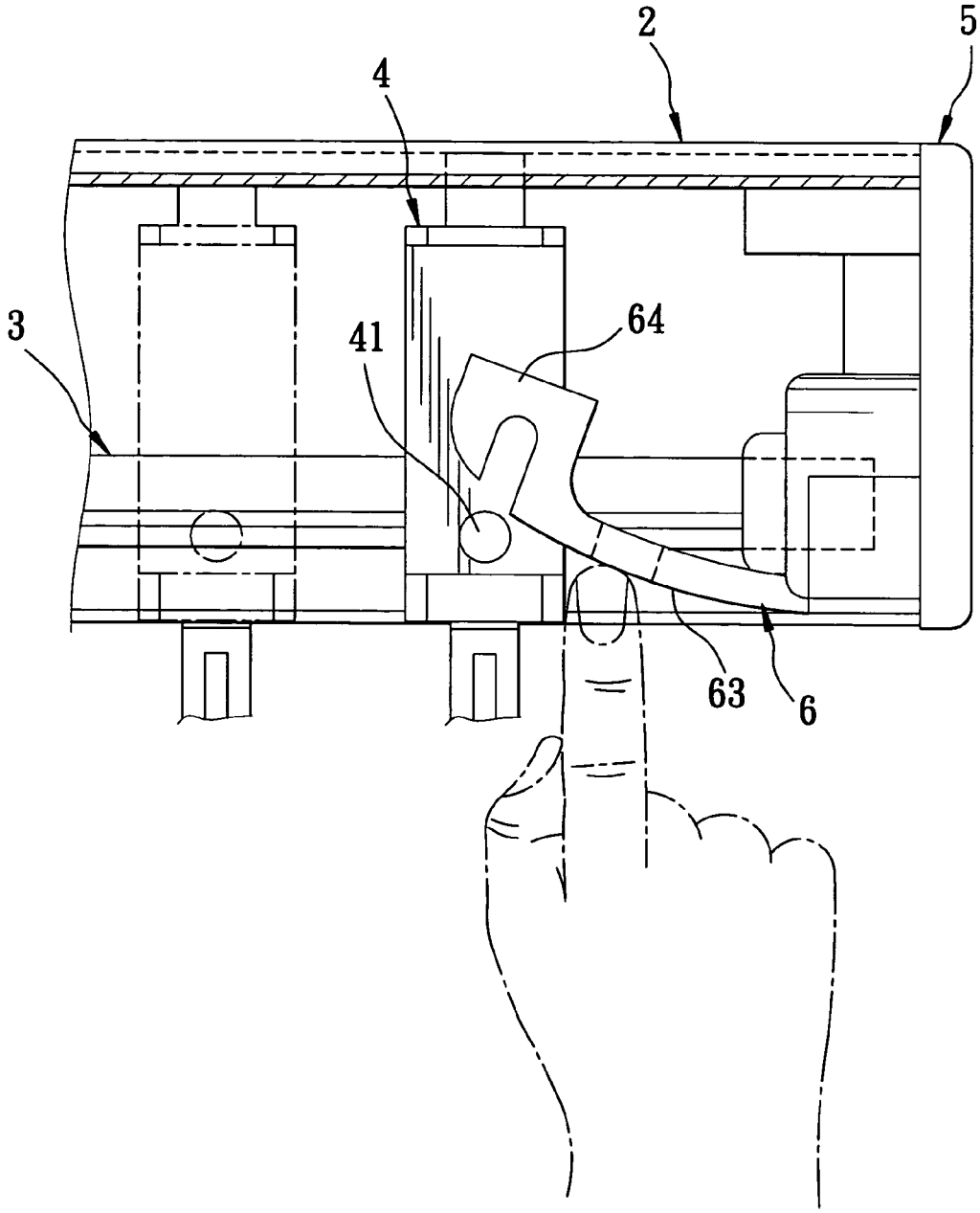
FIG. 7 is a schematic fragmentary side view of the preferred embodiment, illustrating how a positioning member is removed from a carrier.

The hook end 62 of the positioning member 6 includes two hooks 64, each of which is formed with a vertical retaining slot 641 that has a closed upper end and an open lower end and that engages a respective one of the wheel pins 41 of the rightmost carrier 4 so as to prevent movement of the rightmost carrier 4 within the headrail 2. The operable portion 63 of the positioning member 6 is I-shaped, and includes two longitudinal rods 631 disposed between and connected fixedly to the fixed end 61 and the hook end 62 and extending in the longitudinal direction (X) of the headrail 2, and a transverse rod or exposed section 632 extending in the transverse direction (Y) of the headrail 2 and connected respectively and fixedly to middle portions of the longitudinal rods 631. The transverse rod 632 is exposed within a space between the supporting walls 23 of the headrail 2, and is disposed below the rotating shaft 3 so that it can be pushed upwardly to remove the hooks 64 from the wheel pins 41 of the rightmost carrier 4, thereby permitting separation of the rightmost carrier 4 from the end cover 5, as shown in FIG. 7. As such, the positioning member 6 can be removed easily from the rightmost carrier 4 without hurting the operator. Furthermore, because the hook end 62 of the positioning member 6 engages the wheel pins 41 of the rightmost carrier 4 at two opposite sides of the rightmost carrier 4, tilting of the rightmost carrier 4 can be prevented.

Figure 3:
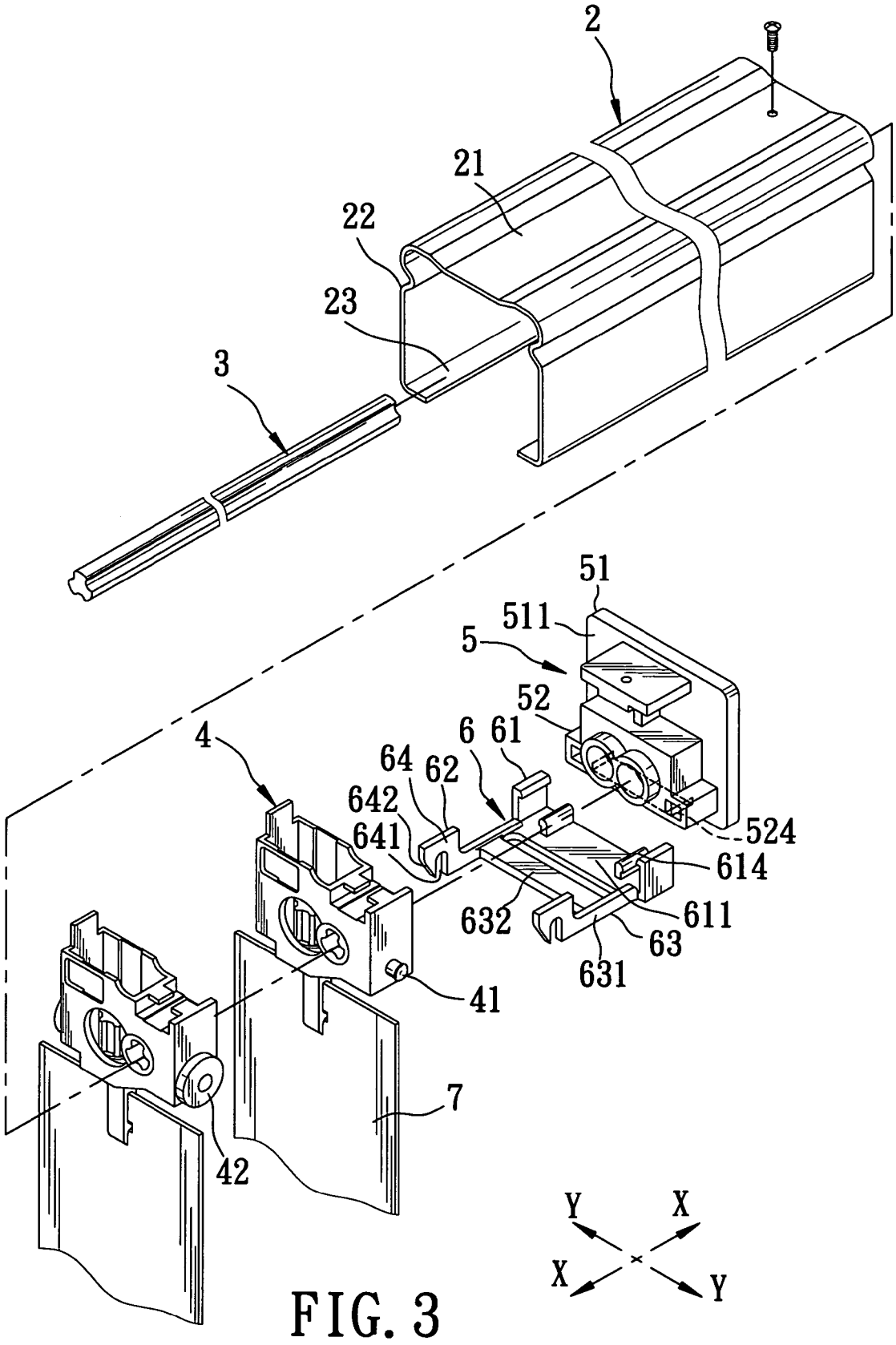
FIG. 3 is a fragmentary partly perspective view of the preferred embodiment of a carrier-positioning device for a vertical blind according to this invention.
Figure 4:
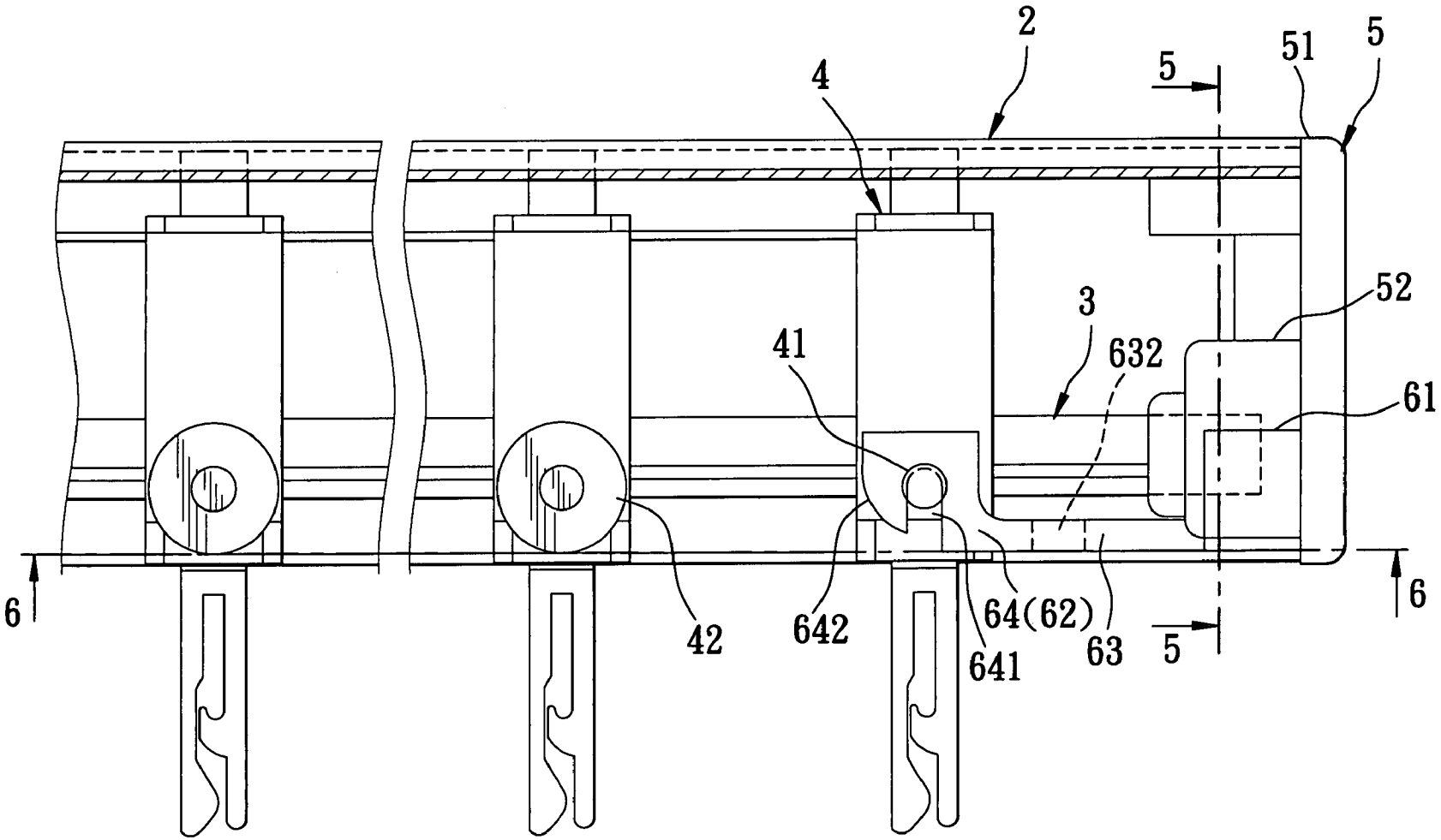
FIG. 4 is a fragmentary sectional view of the preferred embodiment.
Figure 5:
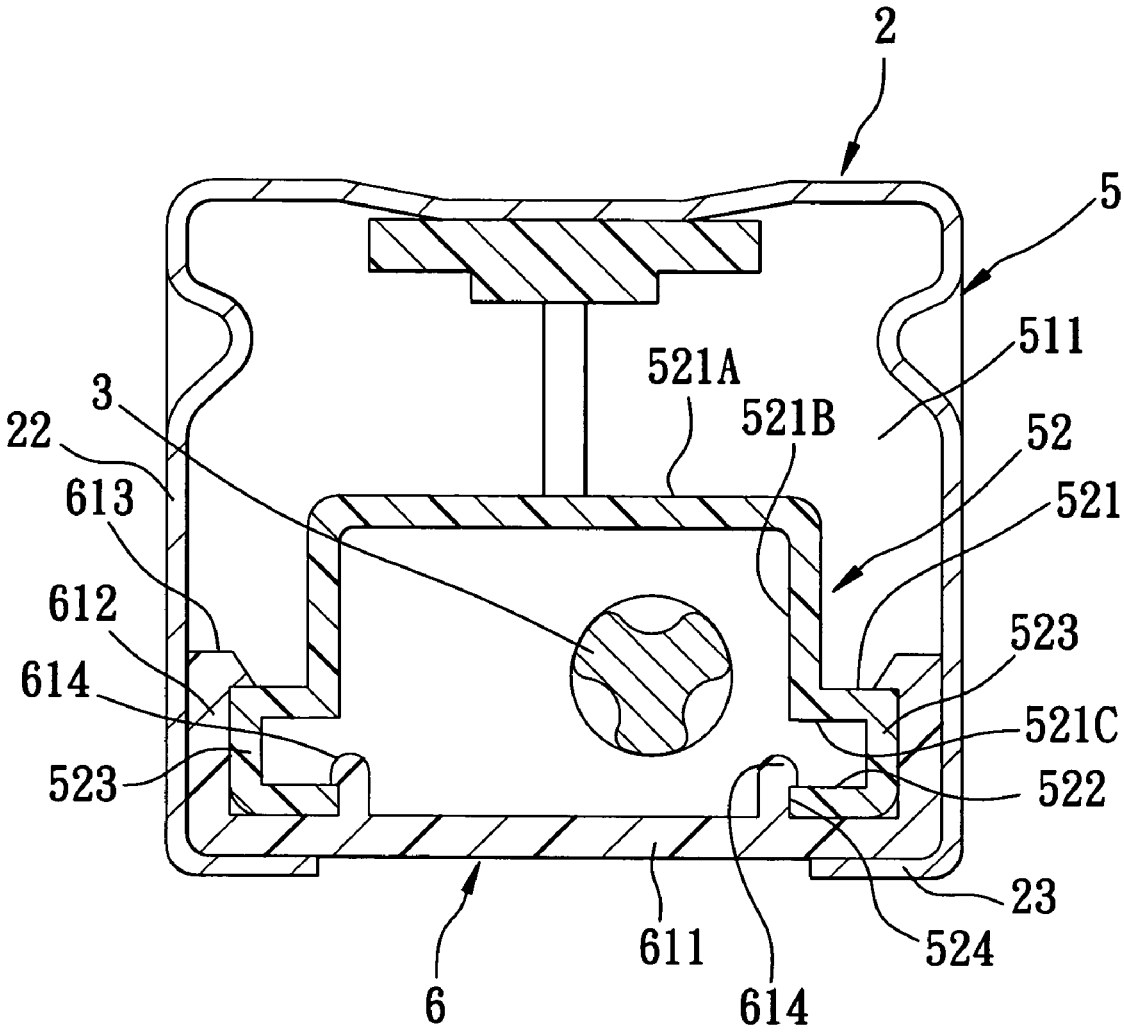
FIG. 5 is a sectional view of the preferred embodiment taken along Line 5—5 in FIG. 4.
Figure 6:
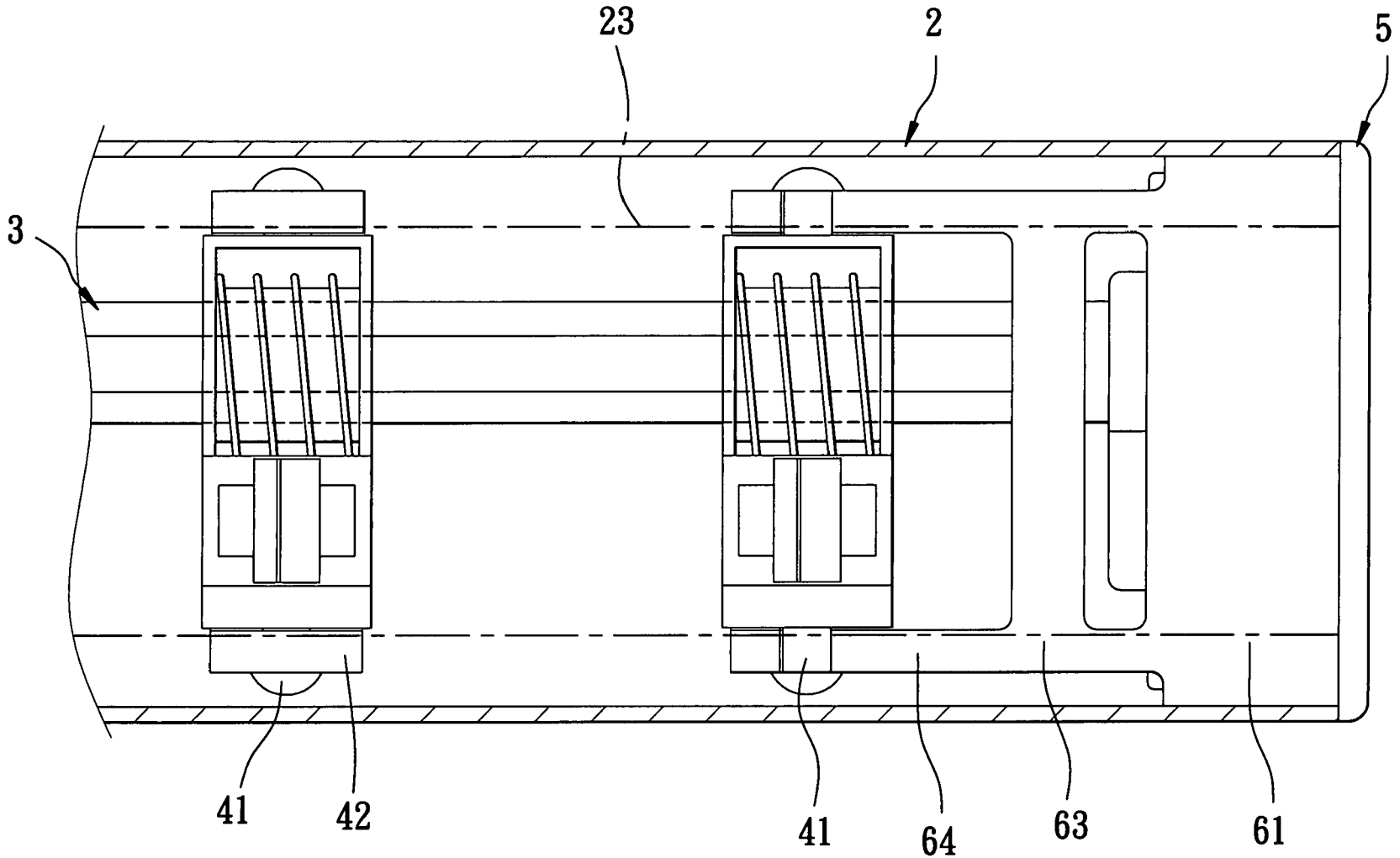
FIG. 6 is a sectional view of the preferred embodiment taken along Line 6—6 in FIG. 4.
Figure 8:
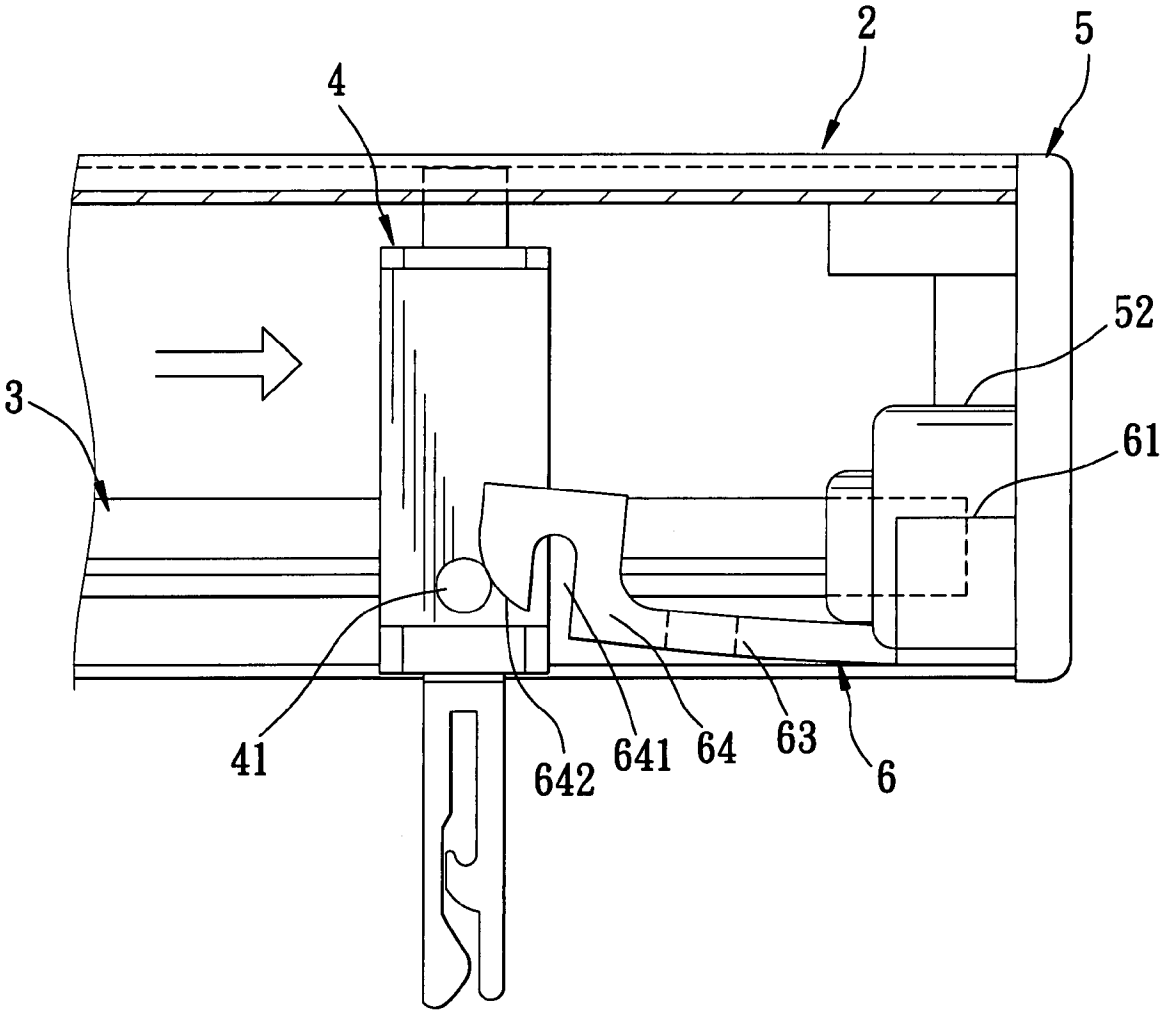
FIG. 8 is a schematic fragmentary side view of the preferred embodiment, illustrating how a wheel pin of the carrier is inserted into a vertical retaining slot in the positioning member.

Referring to FIGS. 3 and 8, each of the hooks 64 of the positioning member 6 is formed with an end surface that has an inclined lower end 642 which is adjacent to the lower end of the vertical retaining slot 641 in the corresponding hook 64. During assembly, when it is desired to engage the wheel pins 41 of the rightmost carrier 4 with the vertical retaining slots 641 in the positioning member 6, the rightmost carrier 4 is pushed toward the positioning member 6 so that the wheel pins 41 are guided by the inclined lower ends 642 of the end surfaces of the hooks 64 of the positioning member 6 to move into the vertical retaining slots 641 in the hooks 64 of the positioning member 64. With this invention thus explained, it is apparent that numerous modifications and variations can be made without departing from the scope and spirit of this invention. It is therefore intended that this invention be limited only as indicated by the appended claims.

We claim:

1. A vertical blind comprising:

a headrail including a top wall, two sidewalls extending respectively and downwardly from two opposite sides of said top wall, and two supporting walls extending respectively from lower ends of said sidewalls toward each other;

a rotating shaft journalled within said headrail;

a carrier sleeved movably around said rotating shaft and movable within said headrail along a longitudinal direction of said headrail, said carrier being formed with two fixed horizontal wheel pins that extend respectively and outwardly from two opposite sides thereof, and two wheels sleeved respectively and rotatably around said wheel pins and movable respectively on said supporting walls so as to facilitate movement of said carrier within said headrail;

a vertical slat suspended from said carrier;

an end cover attached fixedly to an end of said headrail and including a vertical end wall that has an inner side surface proximate to said headrail; and a flexible positioning member having a fixed end connected fixedly to said end cover, a hook end opposite to said fixed end, and an operable portion disposed between and connected fixedly to said fixed end and said hook end, said hook end including two hooks, each of which is formed with a vertical retaining slot that has a closed upper end and an open lower end and that engages a respective one of said wheel pins so as to prevent movement of said carrier within said headrail, said operable portion of said positioning member having an exposed section that is exposed within a space between said supporting walls of said headrail and that is disposed below said rotating shaft so that said operable portion of said positioning member can be pushed upwardly to remove said hooks of said positioning member from said wheel pins, thereby permitting separation of said carrier from said end cover.

2. The vertical blind as claimed in claim 1, wherein each of said hooks of said hook end of said positioning member is formed with an end surface that has an inclined lower end which is adjacent to said lower end of said vertical retaining slot in a corresponding one of said hooks so that a corresponding one of said wheel pins can be guided by said inclined lower end of said end surface to move into said vertical retaining slot in the corresponding one of said hooks during assembly, whereby, when it is desired to engage said wheel pins of said carrier with said vertical retaining slots in said hooks of said hook end of said positioning member, it is only necessary to push said carrier to move within said headrail in a direction toward said positioning member.

3. The vertical blind as claimed in claim 2, wherein said operable portion of said positioning member is I-shaped, and includes two longitudinal rods disposed between and connected fixedly to said fixed end and said hook end of said positioning member, and a transverse rod constituting said exposed section and having two ends that are connected respectively and fixedly to middle portions of said longitudinal rods.

4. The vertical blind as claimed in claim 1, wherein said inner side surface of said end wall of said end cover is formed with an engagement portion that includes a top plate, a bottom plate, and two connecting plates having upper ends that are connected respectively and fixedly to two opposite sides of said top plate, and lower ends that are connected respectively and fixedly to two opposite sides of said bottom plate, said bottom plate having a transverse retaining slot that is formed through an intermediate portion thereof, that extends in a transverse direction of said headrail, and that has two closed ends; and said fixed end of said positioning member includes a base wall abutting against a bottom surface of said bottom plate of said engagement portion of said end cover, two vertical outer walls extending integrally, respectively, and upwardly two opposite sides of said base wall and flanking said engagement portion of said end cover, said outer walls having inner side surfaces that face each other and that abut respectively against said connecting plates of said engagement portion of said end cover so as to prevent movement of said positioning member relative to said end cover in the transverse direction of said headrail, two retaining walls extending respectively from upper ends of said outer walls toward each other and abutting against said top plate of said engagement portion of said end cover so as to prevent vertical movement of said positioning member relative to said end cover, and two ribs projecting integrally and upwardly from said base wall and through said transverse retaining slot in said bottom plate of said engagement portion of said end cover and disposed between said outer walls, said ribs extending in the longitudinal direction of said headrail and having a length proximate to width of said transverse retaining slot in said bottom plate of said engagement portion of said end cover so as to prevent movement of said positioning member relative to said end cover in the longitudinal direction of said headrail.

5. The vertical blind as claimed in claim 1, wherein said positioning member is made of plastic material.

* * * * *